US008695512B2

(12) United States Patent
Nevo et al.

(10) Patent No.: US 8,695,512 B2
(45) Date of Patent: Apr. 15, 2014

(54) NON-FLAT DECK-BOARD PALLET

(75) Inventors: Shlomo Nevo, Tel-Aviv (IL); Rami Remez, Rishon-LeZion (IL)

(73) Assignee: B.B.P. Technologies Ltd., Bazra (IL)

( * ) Notice: Subject to any disclaimer, the term of this patent is extended or adjusted under 35 U.S.C. 154(b) by 29 days.

(21) Appl. No.: 13/202,094

(22) PCT Filed: Feb. 17, 2010

(86) PCT No.: PCT/IL2010/000138

§ 371 (c)(1),
(2), (4) Date: Aug. 18, 2011

(87) PCT Pub. No.: WO2010/095129

PCT Pub. Date: Aug. 26, 2010

(65) Prior Publication Data

US 2012/0037050 A1 Feb. 16, 2012

(30) Foreign Application Priority Data

Feb. 18, 2009 (IL) ..... 197105

(51) Int. Cl.
*B65D 19/00* (2006.01)
*B65D 19/38* (2006.01)

(52) U.S. Cl.
USPC ..... 108/53.3; 108/51.11; 108/57.25

(58) Field of Classification Search
USPC ..... 108/51.11, 55.1–56.3, 57.13, 57.16, 108/53.1–53.5, 57.25
See application file for complete search history.

(56) References Cited

U.S. PATENT DOCUMENTS

| | | | | |
|---|---|---|---|---|
| 1,784,909 | A * | 12/1930 | Romine | 410/40 |
| 2,648,428 | A | 8/1953 | White et al. | |
| 3,433,184 | A * | 3/1969 | Addy | 108/53.3 |
| 4,501,402 | A | 2/1985 | Saito et al. | |
| 5,042,396 | A | 8/1991 | Shuert | |
| 5,636,577 | A * | 6/1997 | Gow | 108/57.17 |
| 5,816,172 | A | 10/1998 | Carter | |
| 6,053,466 | A * | 4/2000 | Jordan et al. | 248/346.01 |
| 6,510,802 | B2 | 1/2003 | Huang et al. | |
| 6,708,628 | B2 | 3/2004 | Halavais | |
| 6,962,115 | B2 | 11/2005 | Markling et al. | |
| 2004/0255828 | A1 | 12/2004 | Markling et al. | |
| 2005/0081763 | A1 | 4/2005 | Von Holle et al. | |
| 2007/0163473 | A1 * | 7/2007 | Shuert | 108/57.25 |

FOREIGN PATENT DOCUMENTS

| | | | |
|---|---|---|---|
| EP | 0718201 | * | 6/1996 |
| JP | 2003-137288 | | 5/2003 |
| WO | WO 94/03368 | | 2/1994 |

(Continued)

OTHER PUBLICATIONS

Office Action Dated Nov. 20, 2011 From the Israel Patent Office Re. Application No. 197105 and Its Translation Into English.

(Continued)

*Primary Examiner* — Darnell Jayne
*Assistant Examiner* — Timothy M Ayres

(57) ABSTRACT

The present invention is a materials-handling pallet with a non-flat-deck, particularly for flexible cargo, which composed of any known pallet's construction, except that its upper deck is not flat. Moreover, the provided pallet can be reinforced by inserting or attaching reinforcing elements and can include a taut cable that prevents or reduces the declining of the upper deck when the pallet is loaded.

25 Claims, 6 Drawing Sheets

(56) References Cited

FOREIGN PATENT DOCUMENTS

| | | |
|---|---|---|
| WO | WO 2008/142647 | 11/2008 |
| WO | WO 2010/095129 | 8/2010 |
| WO | WO 2013/124846 | 8/2013 |

OTHER PUBLICATIONS

International Search Report and the Written Opinion Dated Jun. 8, 2010 From the International Searching Authority Re. Application No. PCT/IL10/00138.

International Preliminary Report on Patentability Dated Sep. 1, 2011 From the International Bureau of WIPO Re. Application No. PCT/IL2010/000138.

Communication Pursuant to Rules 70(2) and 70a(2) EPC Dated Aug. 9, 2013 From the European Patent Office Re. Application No. 09754340.9.

International Search Report and the Written Opinion Dated Jun. 23, 2013 From the International Searching Authority Re. Application No. PCT/IL2013/050148.

Supplementary European Search Report and the European Search Opinion Dated Jul. 23, 2013 From the European Patent Office Re. Application No. 10743466.4.

* cited by examiner

NON-FLAT DECK-BOARD PALLET

RELATED APPLICATIONS

This application is a National Phase of PCT Patent Application No. PCT/IL2010/000138 having International filing date of Feb. 17, 2010, which claims the benefit of priority of Israel Patent Application No. 197105 filed on Feb. 18, 2009. The contents of the above applications are all incorporated herein by reference.

FIELD OF THE INVENTION

The present invention relates to the field of transportation. More specifically, the present invention relates to pallets for materials handling.

BACKGROUND OF THE INVENTION

A pallet is a flat transport structure that supports goods in a stable fashion while being lifted by a forklift, pallet jack, or other jacking device. While the majority of pallets are made of wood, pallets manufactured from plastic, metal, and paper can also be found. Each material has advantages and disadvantages relative to the others.

The pallet is comprised of a flat deck-board, which can be made either of a single part or plurality of parts (e.g., log plates), and some stringers that elevate the deck-board, enabling lifting by a forklift. The stringers can be replaced by several blocks (or "legs") in order to enable lifting from the four ways.

A pallet is intended to serve its purpose in the following positions:

Static load—Where a loaded pallets stays on the floor.

Stacking mode—Where several pallets are loaded one on top of the other. This is mainly another option of storage.

Dynamic payload—When a loaded pallet is moved about by forklift.

Racking—The pallet is supported by its edges on 2 beams.

A pallet can be made of different materials and different reinforced structures, but its upper deck is always flat enabling the easy loading or unloading of goods on it. Since the upper deck is designed to hold heavy goods, it usually made from strong and thick material with or without reinforcements. Moreover, a flat deck has the tendency to sink while a heavy load on it. This tendency is dangerous when such a pallet is stored in a "racking" position wherein the pallet is supported by its edges on two beams.

It is well known that raised forms are stronger than flat forms; the best known shape is the Roman Arch. A pallet whose upper deck is raised form designed is stronger and can be produced with fewer raw materials.

Obviously, a nonflat deck is unsuitable for loading flat bottom goods on it. Therefore, the main object of the present invention is to provide a material-handling-pallet with a non-flat-deck for transporting flexible cargo i.e., bulk in a big-bag.

The non-flat-deck pallet supports the industry where the "Big-Bag" is the main product and will guarantee better racking and a much better grip as oppose to a standard flat surface.

SUMMARY OF THE INVENTION

The present invention is a materials-handling pallet with a non-flat-deck, particularly for flexible cargo, which composed of any known pallet's construction, except that its upper deck is not flat. Moreover, the provided pallet can be reinforced by inserting or attaching reinforcing elements and can include a taut cable that prevents or reduces the declining of the upper deck when the pallet is loaded.

This construction enables the production of a pallet with the ratio of 1 Kg of raw material for each 150 Kg cargo load capability. Moreover, the stringers of the provided pallet can be generally hollow and with a defined internal cavity that is configured to receive a stringer of other pallet, which enables nesting several pallets.

According to the specifications of the present invention, this is a materials-handling pallet with a non-flat-deck, particularly for flexible cargo, composed of any kind of structure wherein the upper deck of this pallet is not flat.

According to a preferred embodiment, the pallet is designed wherein at least part of the upper deck is a raised, specially designed form.

According to another preferred embodiment, the pallet is designed wherein the specially designed form is reinforced by inserting or attaching additional reinforces elements.

According to another preferred embodiment, the pallet is designed wherein the upper deck is divided into a plurality of parts, either symmetric or not, and wherein at least one of these parts is a raised designed form, a cupola or convex shape form.

According to another preferred embodiment, the pallet is designed, wherein at least part of the forms are made of material with variable cross-sectional thickness According to another preferred embodiment the pallet is designed, wherein each stringer of the pallet is being generally hollow and with a defined internal cavity. This internal cavity is configured to receive a stringer of other pallet, enabling the nesting of a plurality of pallets.

According to another aspect of the present invention, the pallet is of any type of construction, wherein the upper deck of the pallet is arch-shaped or sphere-shaped.

According to a preferred embodiment, the arch or sphere shaped pallet further includes at least one taut cable that is connected between the upper desk's bottom edges in order to prevent or reduce the declining of the upper deck while it is loaded. The cable can be connected along the length or width, or both, of the pallet.

According to another preferred embodiment, the arch or sphere shaped pallet is designed wherein cables are connected along each stringer, between the stringer ends.

The present invention successfully addresses the shortcomings of existing technologies by providing a material-handling-pallet with a non-flat-deck. The pallet of the present invention is simple, reliable and inexpensive.

BRIEF DESCRIPTION OF THE FIGURES

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented to provide what is believed to be the most useful and readily understood description of the principles and conceptual aspects of the invention. In this regard, no attempt is made to show structural details of the invention in more detail than is necessary for a fundamental understanding of the invention. The description taken with the drawings make apparent to those skilled in the art how the several forms of the invention may be embodied in practice.

In the figures.

DESCRIPTION OF THE PREFERRED EMBODIMENTS

Figure 1:
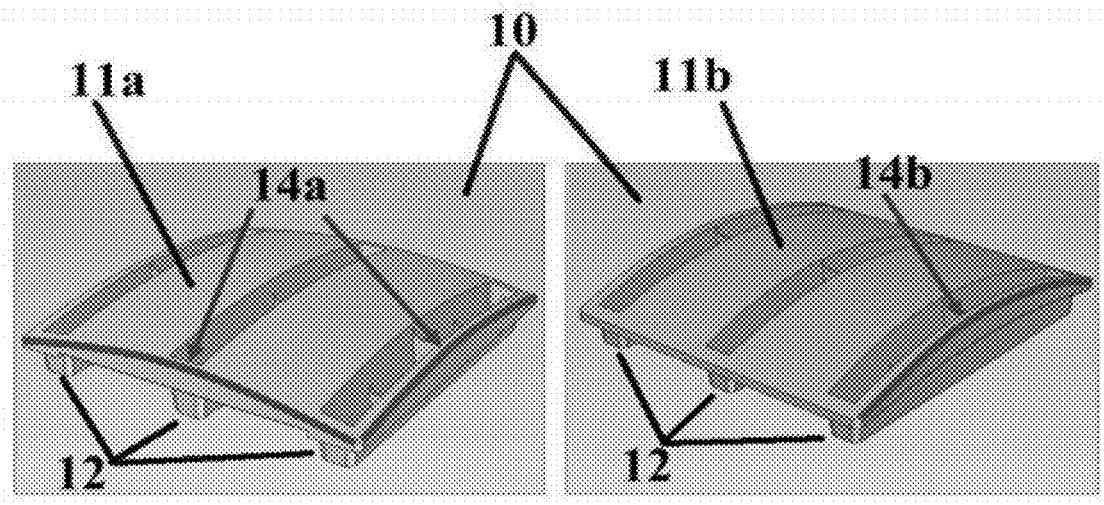
FIG. 1 illustrates arch and sphere shaped pallet.

The present invention is a materials-handling pallet with a non-flat-deck, which composed of any kind of pallet construction with the exception that its upper deck is not flat. Moreover, the said pallet can be reinforced by inserting or attaching reinforce-elements and can include a taut cable that prevents or reduces the declining of the upper deck while the pallet is loaded.

The principles and operation of the pallet according to the present invention may be better understood with reference to the drawing and the accompanying description.

Referring to the drawing, FIG. 1 illustrates arch and sphere shaped pallet. The pallet 10 is illustrated as a sphere shape (FIG. 1A) and an arch shape (FIG. 1B). In figure A the upper deck 11*a* is sphere shaped with arched contour 14*a* from both sides. In figure B the upper deck 11*b* is arch shaped with arched contour 14*b* from one side. In this illustration the pallets are divided into two parts with dints of the stringers 12 in the sides and in the middle, enabling nesting of several pallets.

Figure 2:
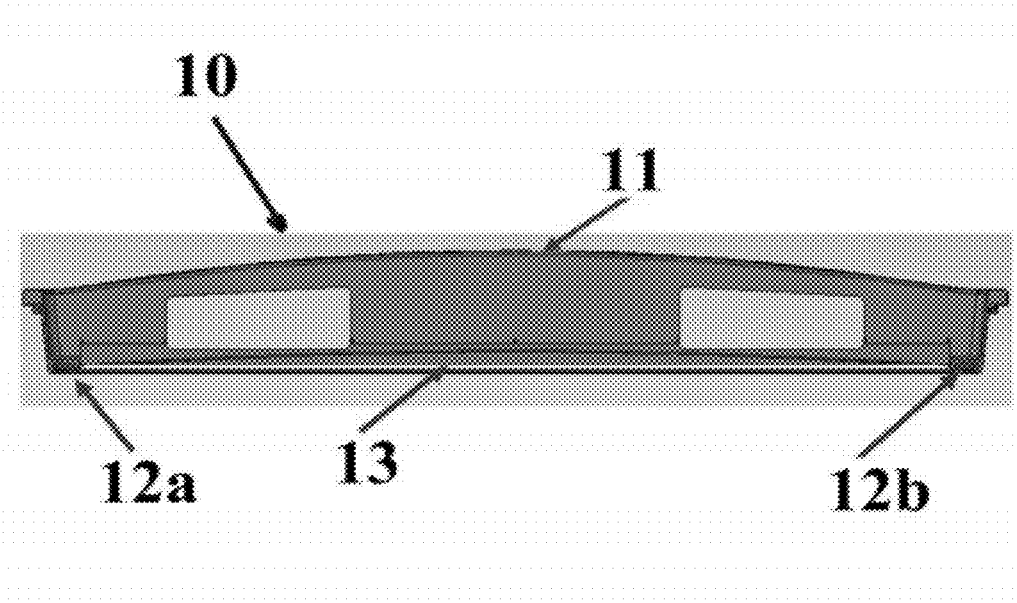
FIG. 2 illustrates a cross section of an arch shaped pallet.

FIG. 2 illustrates a cross section of an arch shaped pallet. The pallet 10 has an arch shaped upper deck. In order to prevent or reduce the declining of the upper deck 11 while the pallet is loaded—while loading or during the storage time—a taut cable 13 or cables are connected along the stringers 12 between first end of the stringer 12*a* and the second end of the stringer 12*b*.

Figure 3:
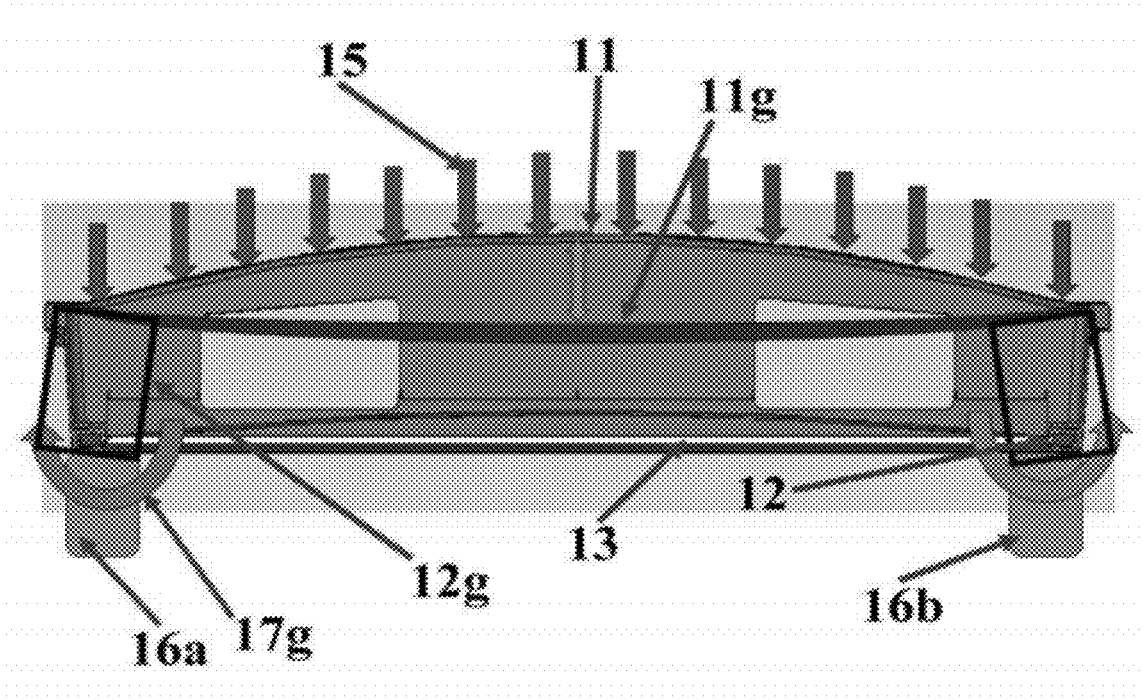
FIG. 3 illustrates the cable's function in the construction.

FIG. 3 illustrates the cable's function in the construction, using a cross section. In some cases loaded pallets are stored in a rack that is made of two rails 16*a*&16*b* on which the pallet's stringers 12 are laid. The cargo that is loaded on the pallet usually pressures 15 the upper deck 11 and decline it to a new lower position 11*g* and distort out 17*g* the stringers 12*g*. The new position is unstable and danger. In order to prevent or reduce the declining, taut cables 13 are connected along each stringer between both ends. The cables absorb the cargo pressure 15. The upper deck 11 can be designed to a minor declining while loaded or to a declining to flat in maximal load.

Figure 4:
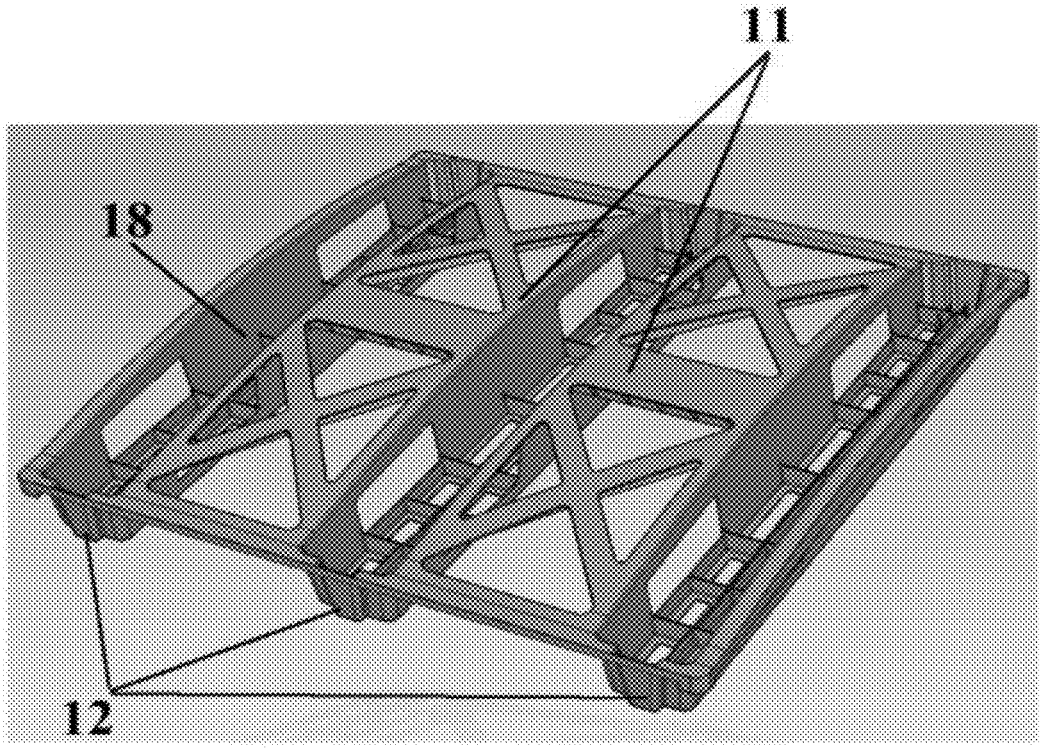
FIG. 4 illustrates a pallet of the present invention made by plastic-injection molding technology.

FIG. 4 illustrates an upper view of a pallet of the present invention made by plastic-injection molding technology. This pallet has an upper deck 11 that is made of two arches shaped designed forms 11 with three stringers 12 that are being generally hollow and with a defined internal cavity 18 to enable nesting of several similar pallets.

Figure 5:
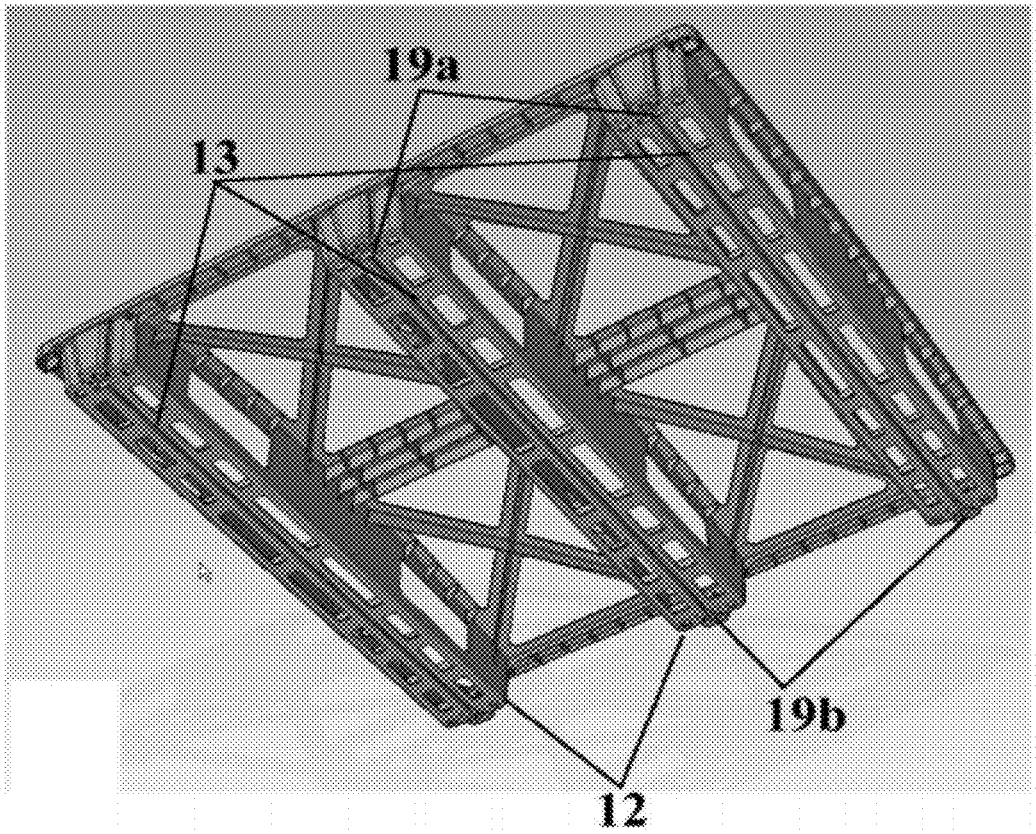
FIG. 5 illustrates a bottom view of a pallet made by plastic-injection molding technology.

FIG. 5 illustrates a bottom view of a pallet made by plastic-injection molding technology. This figure shows three cables 13, each cable connected along each stringer 12 and taut between the connecting means 19*a* and 19*b*.

Figure 6:
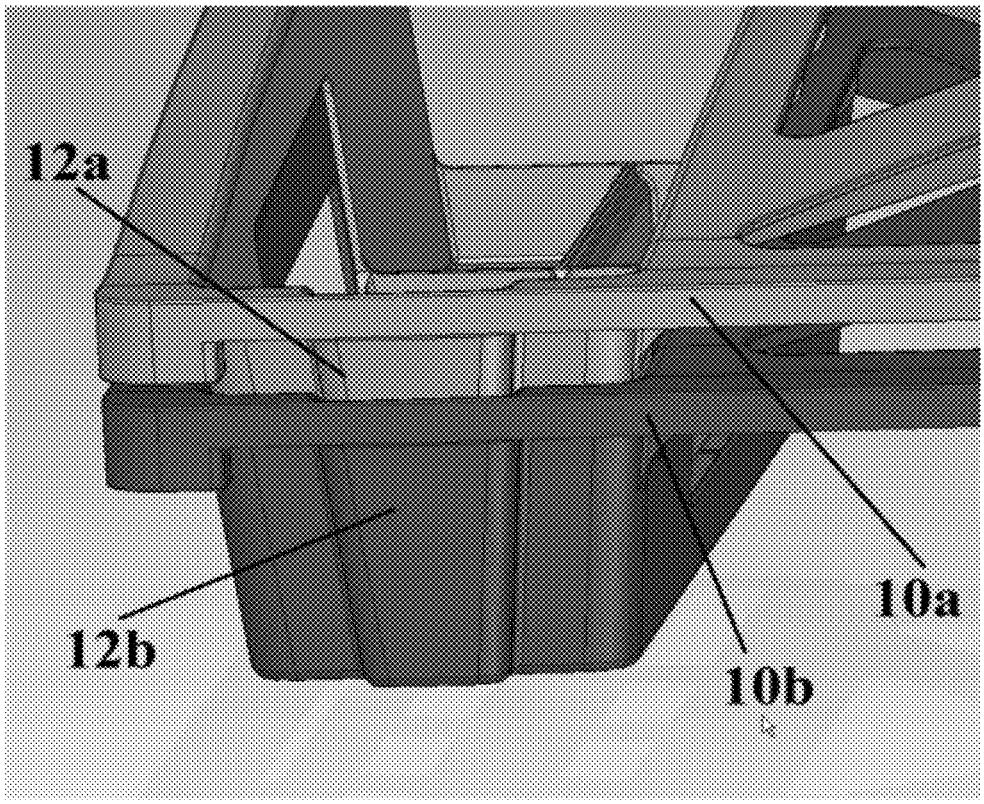
FIG. 6 illustrates the nesting capability.

FIG. 6 illustrates the nesting capability. Each stringer is generally hollow and with a defined internal cavity, this internal cavity configured to receive the stringer 12*a* of the upper pallet 10*a* into the stringer 12*b* of the lower pallet 10*b*. By this method, several pallets can be nested.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A pallet comprising:

a convex surface having four edges, each edge having a first and second end, wherein at least two opposite edges have a convex shape between said first and second ends;

at least two indentations in said convex surface defining at least two stringers respectively, each of the at least two stringers having a first and second end connected to the first and second ends of said opposite edges; and at least one taut cable connected between a first end and a second end at a bottom part of at least one of said stringers, said taut cable adapted to prevent or reduce declining of the at least one stringer when the pallet is loaded, wherein the indentations are sized to receive a matching stringer and taut cable of another pallet and wherein the at least two stringers each has a planar bottom surface geometry extending from the first end to the second end lying on a same plane.

2. A pallet according to claim 1, wherein at least one taut cable is connected along a width of pallet.

3. A pallet according to claim 1, wherein at least one taut cable is connected along a length of pallet.

4. A pallet according to claim 1, wherein the convex surface is arch shaped.

5. A pallet according to claim 1, wherein the convex surface is sphere shaped.

6. A pallet according to claim 1, wherein at least two stringers comprise three stringers.

7. A pallet according to claim 1, wherein at least one taut cable comprises at least two taut cables.

8. A pallet according to claim 1 wherein at least one taut cable comprises three taut cables.

9. A pallet according to claim 1, wherein the pallet comprises an additional surface and wherein at least one of said stringers is connected between the convex surface and additional surface.

10. A pallet according to claim 9, wherein the additional surface has a convex shaped form.

11. A pallet according to claim 9, wherein the additional surface has a cupola shaped form.

12. A pallet according to claim 9, wherein said convex surface and said additional surface are symmetric.

13. A pallet according to claim 1, wherein said pallet is made of plastic.

14. A pallet according to claim 1, wherein said pallet is made by plastic-injection molding technology.

15. A pallet according to claim 1, wherein said convex surface is designed to keep its convex shape when said pallet is loaded.

16. A pallet according to claim 1, wherein said convex surface is designed to have a flat shape when said pallet is loaded.

17. A pallet according to claim 1, wherein said convex surface is an upper deck of the pallet.

18. A pallet according to claim 1, wherein said pallet comprises a ratio of about 1 Kg of raw material for each 150 Kg load capability of the pallet.

19. A pallet according to claim 1, wherein said at least two stringers are adapted to be placed on a rack which is made of a first rail and a second rail such that the pallet is supported by the stringers only, wherein the first ends of the stringers are positioned on the first rail and the second ends of the stringers are positioned on the second rail.

20. A pallet according to claim 1, wherein an upper portion of walls of the at least two stringers define part of the convex surface.

21. A pallet according to claim 1, wherein the at least two stringers prevent or reduce declining of said convex surface into a gap below the convex surface and between the at least two stringers.

22. A pallet according to claim 1, wherein the at least two stringers are substantially parallel to the opposite edges.

23. A method of loading the pallet of claim 1, the method comprising:

positioning a load on said convex surface; and reducing declining of the stringers by said taut cables.

24. A method according to claim 23, further comprising:

racking said pallet by positioning said stringers on a first rail and a second rail such that the first ends of said stringers are positioned on the first rail and the second ends of said stringers are positioned on the second rail.

25. A method according to claim 23, further comprising:

removing said load from the surface; and nesting said pallet by positioning said stringers into indentations of another pallet.

* * * * *